United States Patent [19]

Hutchison et al.

[11] Patent Number: 4,958,588

[45] Date of Patent: Sep. 25, 1990

[54] SOLDER-COATING FIXTURE AND ARRANGEMENT

[75] Inventors: Steven Hutchison, Centereach; Leonard Bruno, Islip, both of N.Y.

[73] Assignee: United Technologies Corporation, Hartford, Conn.

[21] Appl. No.: 344,785

[22] Filed: Apr. 28, 1989

[51] Int. Cl.[5] ..... B05C 3/02

[52] U.S. Cl. ..... 118/423; 118/428; 118/500; 228/36

[58] Field of Search ..... 118/423, 425, 428, 500; 427/123, 431; 228/36, 40

[56] References Cited

U.S. PATENT DOCUMENTS

| | | | |
|---|---|---|---|
| 2,015,929 | 10/1935 | Goodwin | 118/428 |
| 2,609,269 | 9/1952 | Ryan et al. | 118/428 X |
| 2,744,635 | 5/1956 | Hiss | 118/500 X |
| 3,834,349 | 9/1974 | Dietze et al. | 118/500 |
| 4,572,101 | 2/1986 | Lee | 118/500 |
| 4,841,906 | 6/1989 | DeGreest, Jr. | 118/500 |
| 4,869,418 | 9/1989 | Simpson et al. | 228/40 X |

*Primary Examiner*—Richard L. Chiesa
*Attorney, Agent, or Firm*—Peter R. Ruzek

[57] ABSTRACT

An arrangement for solder-coating respective end portions of elongated components in a molten solder bath includes a fixture to be loaded with the components. This fixture includes at least one supporting wall that is capable of maintaining the fixture afloat in a predetermined position on an upper surface of the molten solder bath even when the fixture is fully loaded. The supporting wall has at least one opening through which one of the end portions of a respective component passes into the molten solder bath to a depth necessary for the molten solder to coat the respective end portion to the desired extent when the fixture floats in its predetermined position on the molten solder bath. The fixture may be used in conjunction with a handling device which advantageously includes two pin-shaped projections that engage the fixture at two locations spaced from one another along a horizontal axis with freedom of movement of the fixture relative to the projections at least in the upward direction in that the projections are received in respective vertical slots of the fixture. These projections are then moved at least downwardly to an extent necessary at least to lower the fixture onto the upper surface of the molten bath and then to release the fixture for free floating on the upper surface of the molten solder bath.

10 Claims, 2 Drawing Sheets

SOLDER-COATING FIXTURE AND ARRANGEMENT

DESCRIPTION

1. Technical Field

The present invention relates to solder coating in general, and more particularly to a method and arrangement for solder-coating electrical component leads and to a fixture designed to be used in the performance of such method and/or in such an arrangement.

2. Background Art

There are already known various constructions of arrangements for solder-coating the leads of electrical or electronic components, among them such that perform the solder-coating operation in a fully automated manner. So, for instance, it is known to cause a fixture which is loaded with the components to travel in a course that has such a predetermined and precisely maintained relationship with respect to an area of the upper surface of a molten solder bath that the leads of the components, which project downwardly from the fixture, penetrate into or are dipped in the molten solder bath at the aforementioned area to the extent required to coat the desired lengths of such leads in their entirety with the molten solder. For this approach to be successful, that is, to achieve the requisite solder-coating to the desired point, such as up to the so-called frit area, of each of the components, it is mandatory that the extent to which the leads penetrate into the molten solder bath be maintained substantially invariable over time, that is, from one solder-coating operation to another throughout even a very lengthy series of such operations. To be able to achieve this result, it was necessary when using the heretofore known approaches to employ for the conveyance of the fixture in the required course conveying or other handling equipment that operates with a very high degree of precision (and, consequently, is very expensive) and also to take appropriate measures to assure that the spatial position of the aforementioned area of the molten solder upper surface with respect to the course of travel of the loaded fixture remains the same even as the molten solder is being depleted or replenished (which again adds to the cost of the equipment). Thus, it may be seen that the conventional equipment leaves much to be desired in terms of cost or quality.

Accordingly, it is a general object of the present invention to avoid the disadvantages of the prior art.

More particularly, it is an object of the present invention to provide a solder-coating arrangement which does not possess the disadvantages of the known arrangements of this kind.

Still another object of the present invention is so to construct the solder-coating arrangement of the type here under consideration as to achieve reliable and repeatable solder-coating results over the entire useful lifetime of the arrangement.

A further object of the present invention is to design the arrangement of the above type in such a manner as to be relatively simple in construction, inexpensive to manufacture, easy to use, and yet reliable in operation.

It is yet another object of the present invention to devise a fixture that is especially suited for use in the solder-coating arrangement of the above type but can be used independently thereof as well, which fixture is constructed to assure accurate and reliable solder-coating of only the desired portions of the components carried by the fixture even if the fixture is handled in less than careful or precise manner during the solder-coating operation.

A concomitant object of the present invention is to develop a method of solder-coating the end portions of electrical or electronic components, which method brings about accurate and repeatable solder-coating results.

DISCLOSURE OF THE INVENTION

In keeping with these objects and others which will become apparent hereafter, one feature of the present invention resides in a fixture for solder-coating respective end portions of elongated components that are loaded in the fixture which are placed in a molten solder bath. This fixture includes means for maintaining the fixture afloat in a predetermined position on an upper surface of the molten solder bath even when fully loaded. Such maintaining means includes at least one supporting wall having at least one opening therein for the passage of one of the end portions of a respective component therethrough. The fixture further includes means for holding the respective component on the supporting wall in a position in which the respective end portion thereof passes through the opening and, when the fixture floats in the predetermined position on the molten solder bath, into the molten solder bath to a depth necessary for the molten solder to coat the respective end portion to the desired extent.

Advantageously, the above fixture is used in conjunction with handling equipment that moves the fixture up and down during the solder-coating operation. This equipment includes pin-shaped projections that are movably received in associated slots provided in respective end walls of the fixture and which carry the fixture until the fixture comes to rest on the upper surface of the molten solder bath, after which the projections continue their downward movement so that they slide to a limited extent downwardly in the associated slots, while the fixture remains afloat on the upper surface of the molten bath due at least predominantly to the surface tension of the molten bath.

Thus, it may be seen that, inasmuch as the present invention utilizes the phenomenon of surface tension and/or specific weight difference for floating the fixture at the upper surface, it avoids the vagaries of or need for high-precision performance on the part of the heretofore proposed solder-coating equipment while simultaneously assuring precise positioning of the portions of the components to be coated relative to the molten solder bath during the solder-coating operation.

BRIEF DESCRIPTION OF THE DRAWING

The present invention will be described in more detail below with reference to the accompanying drawing in which.

BEST MODE FOR CARRYING OUT THE INVENTION

Figure 1:
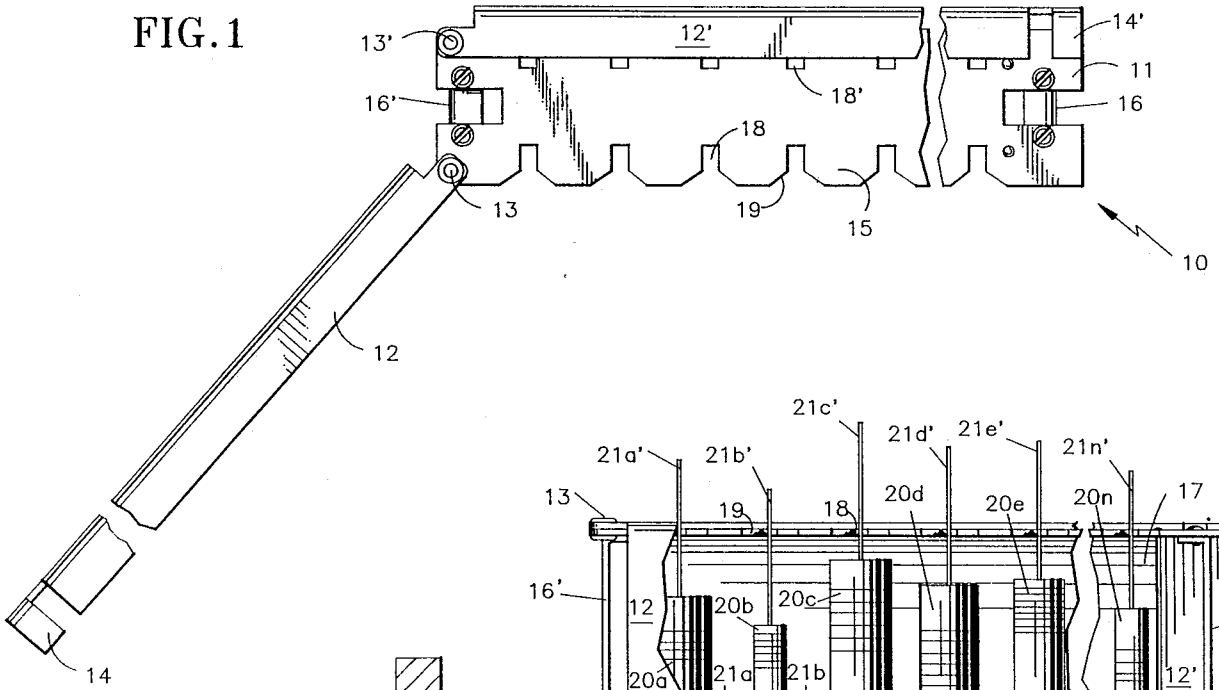
FIG. 1 is a top plan view of a solder-coating fixture constructed in accordance with the present invention.

Referring now to the drawing in detail, and first to FIG. 1 thereof, it may be seen that the reference numeral 10 has been used therein to identify an example of construction of a fixture embodying the present invention and suited for coating electrical leads of components of electrical or electronic circuits with respective coating layers of solder. As illustrated, the fixture 10 basically consists of a main body 11 and of two lids 12 and 12' which are articulated to the main body 11 by respective hinges 13 and 13' for pivoting between their respective open positions shown with respect to the lid 12 and their respective closed positions shown with respect to the lid 12' in the lower and in the upper half of FIG. 1, respectively. The lids 12 and 12' are provided with respective tabs 14 and 14' which resiliently engage the main body 11 when the lids 12 and 12' are in their closed positions and thus hold the lids 12 and 12' in such closed positions against unindented movement toward their open positions as the fixture 10 is being moved or manipulated, until sufficient forces are intentionally applied to the lids 12 and 12' to open them.

Figure 2:
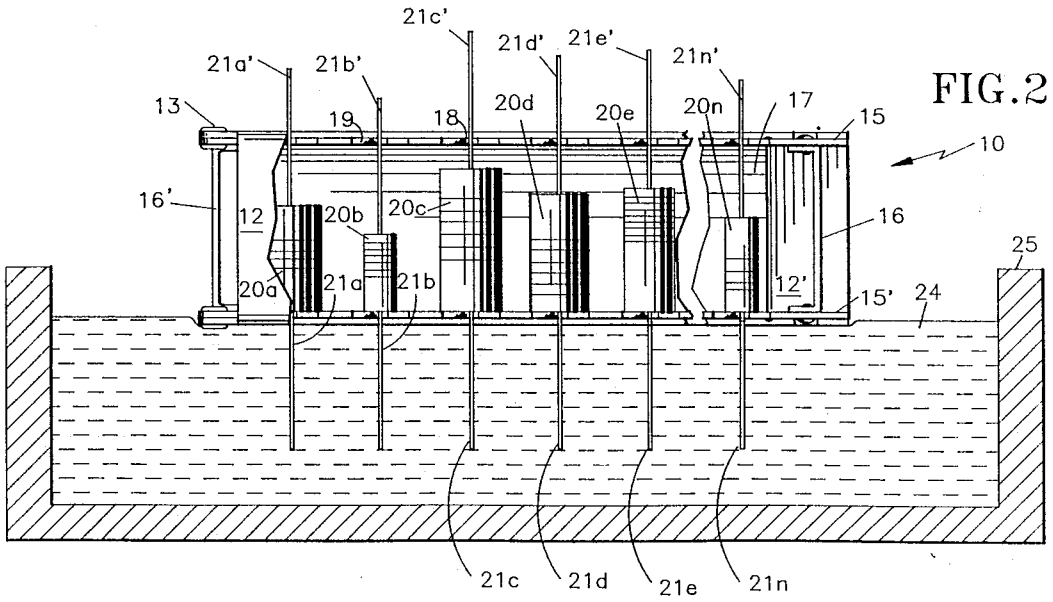
FIG. 2 is a partially sectioned front end view of the fixture of FIG. 1 in its position assumed during the solder-coating operation.

As will become apparent from a comparison of FIGS. 1 and 2 of the drawing, the main body 11 includes first and second support walls 15 and 15' which are shown to be located at the top and the bottom, respectively, in FIG. 2 of the drawing. However, it is to be appreciated that, as will be discussed in more detail later, this is only one of the positions that the fixture 10 assumes during its use and, in fact, the support wall 15' is located at the top and the support wall 15 at the bottom in another of such positions. The first and second support walls 15 and 15' are connected with one another at least by respective end walls 16 and 16', but advantageously also, as illustrated, by a central wall 17 which extends along the plane of FIG. 2, is shown to end short of the end wall 16, and may similarly end short of the end wall 16'.

It can best be seen in FIG. 1 of the drawing that the first support wall 15 is provided with respective holding slots 18 and 18'. Similarly, the second support wall 15' is provided with its own holding slots that have not been specifically shown or identified in the drawing because they correspond to the holding slots 18 and 18' of the first support wall 15. Inasmuch as these holding slots of the second support wall 15' are advantageously substantially aligned with the holding slots 18 and 18' of the first support wall 15 as considered in a direction normal to the plane of FIG. 1 of the drawing, and inasmuch as all of the holding slots serve the same purpose, all of them will be hereafter collectively referred to as holding slots 18 without distinguishing between the support walls 15 and 15' in which they are provided or between their locations on such walls 15 or 15'.

As also illustrated in FIG. 1 of the drawing, each of the holding slots 18 communicates with an enlarged and tapering mouth 19 which opens onto a side surface of the respective support wall 15 or 15' and is shown to be covered by a portion of the respective lid 12 or 12' when the latter is in its closed position. The mouth 19 serves to facilitate the introduction of a respective electric lead 21 a . . . n or 21' a . . . n (wherein n as used here and below denotes any selected positive integral number) of a respective electrical or electronic component 20 a . . . n into the respective holding slot 18 when the respective lid 12 or 12' is open. On the other hand, when the respective lid 12 or 12' is closed, neither it nor the surfaces bounding the respective slot 18 interfere with the movement of the respective component 20 a . . . n in the direction normal to the plane of FIG. 1 of the drawing until the component 20 a . . . n abuts one of the support walls 15 or 15', while they confine the respective leads 21 a . . . n or 21' a . . . n to only a very limited or negligible movements along such plane.

FIG. 2 of the drawing also illustrates how the fixture 10 is being used for solder-coating the electrical leads 21 a . . . n. To accomplish this, the fixture 10 with the components 20 a . . . n held thereon in the above-discussed fashion is placed on top of a body or bath 24 of molten solder that is contained in a receptacle or container 25. Now, in accordance with the present invention, the fixture 10 is made of a material or a combination of materials which, in addition to having a relatively high rigidity and exhibiting a critical point or points at which such material or materials would melt, or at which the structure, rigidity or integrity thereof would be adversely affected in some other manner, that is or are well above the temperature of the molten solder, advantageously either has or have a relatively low specific weight, or at least the surfaces of which that are to come in contact with the molten solder are not wettable by the molten solder, or both. This results in a situation where the fixture 10 will float on top of the molten solder body 24 without being supported in any manner at least in the vertical direction. It is to be realized that the present invention is based on the recognition of, and makes use of, the fact that the molten solder constituting the solder bath 24 exhibits a very high surface tension and/or has a specific weight that exceeds that of the material or materials of which the fixture 10 is made, so that the fixture 10 will be supported on or at the upper surface of the molten solder bath 24 even when it is fully loaded with the components or workpieces 20 a . . . n and even if it is dropped onto such molten bath upper surface from a certain limited yet not negligible height above the molten solder bath 24. Suitable materials for the fixture 10 include titanium or titanium alloys, and also some other metallic materials which may or may not be coated with suitable heat-resistant coatings, such as a layer of polytetrafluoroethylene or the like.

It will be appreciated that, as the loaded fixture 10 is being lowered onto the upper surface of the molten bath 24, the electric leads 21 a . . . n gradually penetrate through the molten solder bath upper surface and become immersed to an increasing extent in the molten solder bath 24. Inasmuch as the leads 21 a . . . n have a pronounced affinity to the solder, either inherently or because they have been pre-treated with flux prior to the commencement of the solder-coating operation, the molten solder will wet and adhere to their surfaces at least to the extent that they are immersed into the molten solder bath 24 so that, after the fixture 10 has been lifted from the molten bath 24, each of the leads 21 a . . . n is covered with a thin coat of solder which solidifies as its temperature drops below the solidus point of the solder.

Having so solder-coated the leads 21 a . . . n of the components 20 a . . . n, one can now proceed to repeat the solder-coating operation with respect to the leads 21' a . . . n of the components 20 a . . . n. To achieve this, the fixture 10 is first turned at a distance from the molten solder bath 24 through 180° about a horizontal axis, typically that extending normal to the end walls 16 and 16', thus situating the second support wall 15' at the top and the first support wall 15 at the bottom of the fixture 10. During this turning operation, the leads 21 a . . . n and 21' a . . . n will slide in the respective slots 18 until the main bodies of the components 20 a . . . n come to rest against the second support wall 15' and thus prevent further sliding. When this happens, the leads 21' a . . . n are in their desired positions for successful solder-coating, so that the fixture 10 can now be lowered, released or otherwise placed onto the upper surface of the molten solder bath 24, where it will once more float with attendant solder-coating of the leads 21' a . . . n in this instance. When this solder-coating operation is completed, the fixture 10 is removed from the molten solder bath 24, the lids 12 and 12' are opened and the components 20 a . . . n are removed from the fixture 10 which thus becomes ready to accept the next load or batch of electrical or electrical components whose leads are to be solder-coated.

Figure 3:
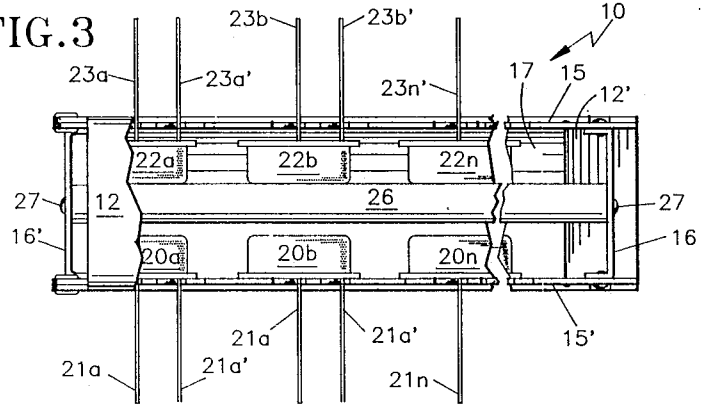
FIG. 3 is a view similar to FIG. 2 but only of the fixture, in a modified version thereof.

FIG. 3 depicts a somewhat modified construction of the fixture 10 which is similar to that discussed above in so many respects that the same reference numerals as before have been used to identify corresponding parts. This fixture 10 is designed for use in a situation where the respective electric leads 21 a . . . n and 21' a . . . n of the electrical or electronic components 20 a . . . n all extend in the same direction from the main bodies or portions of such components 20 a . . . n. In this case, either the slots 18 of the second support wall 15' through which the leads 21 a . . . n and 21' a . . . n are wide enough each to accommodate both of the respective leads, such as 21 a and 21' a, or separate slots 18 are provided for each of the leads, such as 21 a and 21' a, of each of the components 20 a . . . n. As shown, the components 20 a . . . n have axial dimensions as considered in the directions of the leads 21 a . . . n and 21' a . . . n which are less than one-half of the clear distance between the support walls 15 and 15'.

To prevent the components 20 a . . . n from sliding excessively in the direction of the leads 21 a . . . n, and to double the capacity of the fixture 10, a partitioning wall 26 extending substantially normal to the plane of FIG. 3 of the drawing is arranged substantially midway between the support walls 15 and 15' to constitute an abutment for the components 20 a . . . n and also for another set of components 22 a . . . n that are arranged at the upper half of the fixture 10 as considered in the drawing. Each of the components 22 a . . . n has two leads 23 a . . . n and 23' a . . . n which also extend in the same direction from the main body of the respective component 22 a . . . n and pass through the respective slots 18 of the first support wall 15 which are configured similarly to what was discussed previously with respect to the slots 18 of the second support wall 15'. The partitioning wall 26 is secured at least to one of the end walls 16 and 16' by at least one screw 27 or a similar fastener. It will be appreciated that, similarly to what has been described above in conjunction with FIG. 2 of the drawing, the fixture 10 loaded with the components 20 a . . . n and 22 a . . . n will first be lowered onto and float on the upper surface of the molten solder bath 24 in the illustrated spatial position simultaneously to solder-coat the leads 21 a . . . n and 21' a . . . n of the components 20 a . . . n, followed by raising the fixture 10 and turning it through 180° about the horizontal axis with attendant sliding of the components 22 a . . . n into their proper positions, whereupon the fixture 10 is once more lowered onto and floats on the upper surface of the molten solder bath 24 with attendant simultaneous solder-coating of the leads 23 a . . . n and 23' a . . . n of the components 22 a . . . n. Then the fixture 10 is raised again and opened, and the components 20 a . . . n and 22 a . . . n are removed from it, thus readying the fixture 10 for the acceptance of the next load of electronic or electrical components whose leads are to be solder-coated.

The fixture 10 described above can be used in a manually performed solder-coating process in which the operating personnel utilizes tongs or similar handling implements or equipment to lower and raise and/or to turn the fixture 10. It will be appreciated that the manual handling of the fixture 10 does not necessitate a high degree of skill or care on the part of the operating personnel, especially since the loaded fixture 10 need not be carefully placed on the upper surface of the molten solder bath 24 before being released; rather, it can be released while still at a limited yet significant distance above the upper surface of the bath 24, or even after it has been slightly dipped into the bath 24, inasmuch as the surface tension of the molten solder causes the fixture 1? to equilibrate in the proper position and prevents excessive solder-coating.

Figure 4:
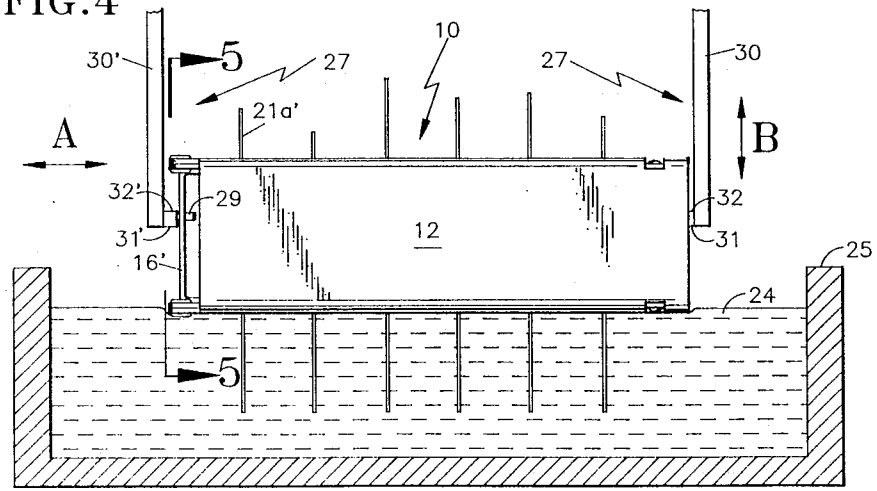
FIG. 4 is a front elevational view of the fixture of FIG. 1 and of relevant portions of handling equipment in positions thereof assumed during the solder-coating operation.

However, this absence of need for precisely positioning the fixture 10 relative to the upper surface of the molten solder bath 24 during the solder-coating operation can also be utilized to advantage in automated handling of the fixture 10, in that it renders it possible to employ relatively low-precision and hence low-cost automated equipment or robots for handling the fixture 10 during the solder-coating operation. An example of operative parts of equipment of the above type, and of additional features of the fixture 10 which make the latter compatible with such operative parts, is illustrated in a simplified manner in FIGS. 4 and 5 of the drawing, where the same reference numerals as before are being used to identify corresponding parts, and the reference numeral 27 denotes the handling equipment or, more specifically, the operative parts thereof.

Figure 5:
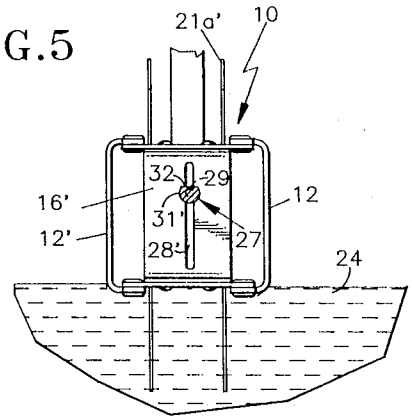
FIG. 5 is a partially sectioned end view taken on line 5—5 of FIG. 4.

As shown in FIG. 5, the end wall 16' has a slot 28 therein which extends substantially vertically in the illustrated position of the fixture 10. The end wall 16 also has a vertical slot 28 therein, but this additional slot 28 has not been shown in the drawing since it corresponds to and is generally parallel to the slot 28 of the end wall 16' and its arrangement and function will be apparent from the following description. As a comparison of FIGS. 4 and 5 of the drawing will reveal, the slot 28 serves to accommodate a portion of a pin-shaped projection 29 of a respective arm 30 or 30' of the equipment 27. The arms 30 and 30' may be movable together and apart as indicated by a double-headed arrow A to engage and release the fixture 10, and they are jointly movable in opposite vertical directions, as indicated by a double-headed arrow B, to lower and raise the fixture 10. The arms 30 and 30' are equipped with respective spacers 31 and 31' which are shown to carry the respective projections 29. At least one of the spacers 31 and 31' has a substantially horizontally extending flat, such as 32 and/or 32', at its upper region.

When the fixture 10 is supported solely by the handling equipment 27, the pin-shaped projections 29 are situated at the upper ends of the respective slots 28 and the flat or flats 32 and/or 32' engage corresponding regions of the fixture 10, such as of the supporting walls 15' or 15, to prevent the fixture 10 from rocking during transportation. On the other hand, when other upwardly directed supporting forces act on the fixture 10, such as when the fixture 10 is placed onto a horizontal surface, such as the upper surface of the molten solder bath 24, these upward supporting forces will cause relative movement of the projections 29 downwardly in the slots 28 when the arms 30 and 30' continue their downward movement after the upward supporting forces have come into being. This, in turn, means that the projections 29 will not exert any downwardly oriented forces on the fixture 10 so long as they do not reach the bottom ends of the respective slots 28 and, therefore, will not cause any additional immersion of the fixture 10 into the molten bath 24 or any additional strain on the upper surface of the molten bath 24 beyond those attributable to the weight of the loaded fixture 10 which, as mentioned above, can be easily sustained by the liquid solder. Thus, it may be seen that the equipment 27 need not operate with a great degree of precision as it would have to if the equipment 27 were to hold the fixture 10 up at all times during the solder-coating operation, as is customary, so long as it is assured that the pin-shaped projections 29 are situated in the respective slots 28 anywhere between the upper ends and just short of the lower ends thereof, but advantageously in the upper halves of such slots 28, when the fixture 10 is placed onto the molten solder bath 24. This is so because the floating of the loaded fixture 10 on the molten bath 24, rather than precise positioning of the fixture 10 relative to the molten solder bath 24, is utilized to determine the extent to which the molten solder coats the leads, such as 21 n, during the particular solder-coating operation. For the same reason, and subject to the same condition, the exact level of the upper surface of the molten solder bath 24 in the container 25 is no longer critical and it is not necessary either to maintain it within narrow limits, or to adjust the operation of the equipment 10 as the molten solder bath is being depleted and as it is subsequently replenished, as was necessary with prior art approaches.

As mentioned before, it is advantageous to control the operating parameters in such a manner that, even though the slots 28 extend substantially the same distance below a central horizontal plane of the fixture 10 as they do above this central plane, the pin-shaped projections 29 remain in the upper halves of the slots 28 during the particular solder-coating operation. The reason for this is that, inasmuch as the pin-shaped projections 29 are thus always situated above the center of gravity of the loaded fixture 10, the likelihood that the fixture 10 would inadvertently and unpredictably turn upside down during the lifting off the fixture 10 from the molten solder bath 24 around a horizontal axis on which the projections 29 are centered is reduced to a minimum if not eliminated. On the other hand, when the fixture 10 is turned upside down on purpose, as it is following the conclusion of the solder-coating operation on the leads 21 a . . . n in preparation for the solder-coating of the leads 21' a . . . n, the projections 29 slide in the slots 28 from the previous upper ends, now lower ends, of the slots 28 into the current upper ends of the slots 28, so that the center of gravity of the loaded fixture 10 becomes once more situated below the aforementioned horizontal axis of the pin-shaped projections 29.

Figure 6:
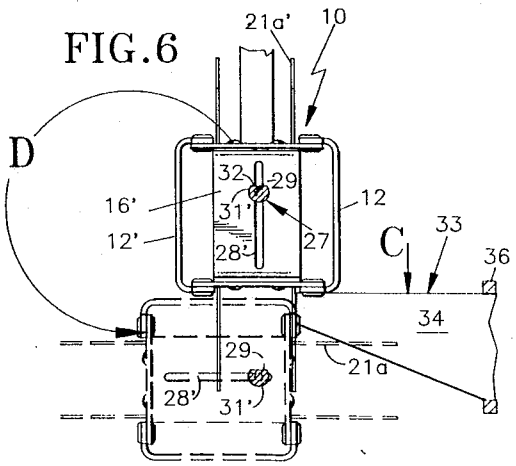
FIG. 6 is a view similar to that of FIG. 5 but showing the fixture and the handling equipment during their cooperation with an arrangement for turning the fixture upside down between successive solder-coating operations.

While the upside-down turning of the fixture 10 can be accomplished in any desired manner using any selected equipment, it is especially advantageous, particularly when the fixture 10 is being handled by the automated or robotic equipment 27 to begin with, to employ a turning arrangement 33 of the kind embodying another aspect of the present invention as illustrated in FIG. 6 of the drawing. The turning arrangement 33 includes at least one finger 34, but preferably two or even more of such fingers 34. The finger 34, or each of the fingers 34, is mounted in a cantilevered fashion on a support 36 and has a thickness as considered in a direction normal to the plane of FIG. 6 which is smaller than the clear distance between the adjacent ones of the leads 21 a . . . n and 21' a . . . n so that it can be inserted between them without coming into contact therewith. The extent of insertion is usually substantially less than half-way of the fixture 10. After such insertion, relative movement substantially in the vertical direction is performed between the fixture 10 and the support 36, as indicated by an arrow C for movement of the fixture 10 relative to the support 36, so that the fixture 10 comes to rest on the upper surface of the finger 34 and then the projections 29 ride up in the respective slots 28, for instance into the position shown in solid lines in FIG. 6. When this movement is then continued, the fixture 10 is gradually tilted or turned about the axis of the pin-shaped projections 29, as indicated by an arrow D, so that the fixture 10 eventually reaches its position illustrated in broken lines in FIG. 6 in which the pin-shaped projections 29 are disposed in the end portions of the respective slots 2 that used to be the lower end portions. Thereafter, during continuation of the aforementioned movement, the fixture 10 rights itself up in its upside-down position, that is, completes its turning through 180° about the axis of the pin-shaped projections 29, and the fixture 10 can then be backed away from the finger or fingers 34 in the right position for the next following solder-coating operation.

It may be seen from the above description that, when the fixture 10 of the present invention is being used in conjunction with the robotic or other similar handling equipment 27, it permits for several relatively wide tolerance ranges. One of these ranges is that of the robot over-travel. Thus, the robot can be programmed for significant over-travel, for instance, such that the robot-to-solder bath depth placement inaccuracy is as much as 0.25". Another one of such relatively wide tolerance ranges is that of variations in the solder bath depth, where the solder pot to solder surface height may vary by, for example +/−0.125". This permits the use of a fairly inexpensive robot, without sacrificing the precision or quality of the solder coating. It will also be appreciated that, because of the design and construction of the fixture 10 in the manner discussed above, the fixture 10 is capable of being used for solder-coating a wide variety of components (such as 20 a . . . n) of different dimensions by designing the fixture 10 for the largest component anticipated. Then, the accommodation of the leads or similar portions (such as 21 a . . . n and 21' a a . . . n) in the respective slots 18 for sliding in the axial directions thereof allows the respective component (such as 20 a . . . n) to always assume such a rest position just prior to the respective solder-coating operation that the solder reaches to the desired level, even after the fixture 10 has been turned through 180° from its position in which the components (such as 20 a . . . n) have been loaded thereinto.

While the present invention has been illustrated and described as embodied in a particular construction of a solder-coating fixture and an automatic equipment for performing a solder-coating operation, it will be appreciated that the present invention is not limited to this particular example; rather, the scope of protection of the present invention is to be determined solely from the attached claims.

We claim:

1. A fixture for solder-coating respective end portions of elongated components that are loaded in the fixture in a molten solder bath, comprising means for maintaining the fixture afloat in a predetermined position on an upper surface of the molten solder bath even when fully loaded, including at least one solid supporting wall having at least one opening therein for the passage of one of the end portions of a respective component therethrough and kept from sinking into the molten solder bath solely by surface tension effective between said solid supporting wall and the molten solder bath in said predetermined position of the fixture; and means for holding the respective component on said supporting wall in a position in which the respective end portion thereof passes through said opening and, when the fixture floats in said predetermined position on the molten solder bath, into the molten solder bath to a depth necessary for the molten solder to coat the respective end portion to the desired extent.

2. The fixture as defined in claim 1 for use in simultaneous solder-coating of a plurality of the end portions, wherein said supporting wall has at least one additional opening similar to and spaced from said one opening for the passage of another of the end portions to be solder-coated therethrough.

3. The fixture as defined in claim 1 and further comprising an additional supporting wall similar to said one supporting wall and having at least one auxiliary opening therein for the passage therethrough of another end portion of the respective component; and means for so connecting said additional supporting wall to said one supporting wall as to be spaced therefrom longitudinally of the respective component with said auxiliary opening being substantially aligned with said one opening.

4. A fixture for solder-coating respective end portions of elongated components that are loaded in the fixture in a molten solder bath, comprising means for maintaining the fixture afloat in a predetermined position on an upper surface of the molten solder bath even when fully loaded, including at least one supporting wall having at least one opening therein for the passage of one of the end portions of a respective component therethrough;

means for holding the respective component on said supporting wall in a position in which the respective end portion thereof passes through said opening and, when the fixture floats in said predetermined position on the molten solder bath, into the molten solder bath to a depth necessary for the molten solder to coat the respective end portion to the desired extent; and means for maintaining the fixture afloat on the upper surface of the molten solder bath even when fully loaded in another position in which the fixture is turned through 180° about a horizontal axis relative to said predetermined position thereof, including an additional supporting wall similar to said one supporting wall and having at least one auxiliary opening therein for the passage therethrough of another end portion of the respective component, and means for so connecting said additional supporting wall to said one supporting wall as to be spaced therefrom longitudinally of the respective component with said auxiliary opening being substantially aligned with said one opening.

5. An arrangement for solder-coating respective end portions of elongated components in a molten solder bath, comprising a fixture to be loaded with the components, including means for maintaining the fixture afloat in a predetermined position on an upper surface of the molten solder bath even when fully loaded, including at least one solid supporting wall having at least one opening therein for the passage of one of the end potions of a respective component therethrough and kept from sinking into the molten solder bath solely by surface tension effective between said solid supporting wall and the molten solder bath in said predetermined position of the fixture, and means for holding the respective component on said supporting wall in a position in which the respective end portion thereof passes through said opening and, when the fixture floats in said predetermined position on the molten solder bath, into the molten solder bath to a depth necessary for the molten solder to coat the respective end portion to the desired extent; and means for handling the fixture, including means for engaging said fixture at two locations spaced from one another along a horizontal axis with freedom of movement of said fixture relative to said engaging means at least in the upward direction, and means for moving said engaging means at least downwardly to an extent necessary at least to lower the fixture onto the upper surface of the molten bath and then to release said fixture for free floating on the upper surface of the molten solder bath, and subsequently upwardly to raise the fixture from the upper surface of the molten solder bath after re-engagement of said engaging means therewith.

6. The arrangement defined in claim 5 for use in simultaneous solder-coating of a plurality of the end portions, wherein said supporting wall of said fixture has at least one additional opening similar to and spaced from said one opening for the passage of another of the end portions to be solder-coated therethrough.

7. The arrangement as defined in claim 5, wherein said fixture further includes an additional supporting wall similar to said one supporting wall and having at least one auxiliary opening therein for the passage therethrough of another end portion of the respective component, and means for so connecting said additional supporting wall to said one supporting wall as to be spaced therefrom longitudinally of the respective component with said auxiliary opening being substantially aligned with said one opening.

8. An arrangement for solder-coating respective end portions of elongated components in a molten solder bath, comprising a fixture to be loaded with the components, including means for maintaining the fixture afloat in a predetermined position on an upper surface of the molten solder bath even when fully loaded, including at least one supporting wall having at least one opening therein for the passage of one of the end portions of a respective component therethrough, means for holding the respective component on said supporting wall in a position in which the respective end portion thereof passes through said opening and, when the fixture floats in said predetermined position on the molten solder bath, into the molten solder bath to a depth necessary for the molten solder to coat the respective end portion to the desired extent, means for maintaining the fixture afloat on the upper surface of the molten solder bath even when fully loaded in another position in which the fixture is turned through 180° about a horizontal axis relative to said predetermined position thereof, including an additional supporting wall similar to said one supporting wall and having at least one auxiliary opening therein for the passage therethrough of another end portion of the respective component, and means for so connecting said additional supporting wall to said one supporting wall as to be spaced therefrom longitudinally of the respective component with said auxiliary opening being substantially aligned with said one opening; and means for handling the fixture, including means for engaging said fixture at two locations spaced from one another along a horizontal axis with freedom of movement of said fixture relative to said engaging means at least in the upward direction, and means for moving said engaging means at least downwardly to an extent necessary at least to lower the fixture onto the upper surface of the molten bath and then to release said fixture for free floating on the upper surface of the molten solder bath, and subsequently upwardly to raise the fixture from the upper surface of the molten solder bath after re-engagement of said engaging means therewith.

9. The arrangement as defined in claim 8, wherein said connecting means includes two end walls interconnecting said supporting walls at a spacing along said horizontal axis from one another and each having an elongated slot extending substantially vertically in said positions of said fixture; and wherein said engaging means includes a pair of pin-shaped projections centered on and movable together and apart along said horizontal axis and each received in said slot of one of said end walls in an engaging condition of said engaging means for movement longitudinally thereof relative to said fixture.

10. The arrangement as defined in claim 9 and further comprising means for causing the fixture to turn about said horizontal axis between said positions thereof, including a least one finger configured to engage said fixture at a location spaced from the molten bath from below and to one side from said slots, and means for conducting relative movement of said fixture at least in the downward direction with respect to said finger with attendant combined turning of said fixture about said projections and displacement of each of said projections between one end portion of the respective slot and the other.

* * * * *

UNITED STATES PATENT AND TRADEMARK OFFICE

CERTIFICATE OF CORRECTION

PATENT NO. : 4,958,588

DATED : September 25, 1990

INVENTOR(S) : Steven Hutchison et al

It is certified that error appears in the above-identified patent and that said Letters Patent is hereby corrected as shown below:

Claim 5, Column 10, line 22: delete "potions" and insert --portions--.

Claim 6, Column 10, line 49: after "arrangement" insert --as--.

Signed and Sealed this

Second Day of June, 1992

*Attest:*

DOUGLAS B. COMER

*Attesting Officer*

*Acting Commissioner of Patents and Trademarks*